US005355585A

United States Patent [19]

Tepic

[11] Patent Number: 5,355,585

[45] Date of Patent: Oct. 18, 1994

[54] SCISSORS AND REPLACEABLE TORSION BLADE INSERTS FOR SCISSORS

[75] Inventor: Slobodan Tepic, Davos, Switzerland

[73] Assignee: AO-Forschungsinstitut Davos, Davos Platz, Switzerland

[21] Appl. No.: 180,506

[22] Filed: Jan. 12, 1994

Related U.S. Application Data

[63] Continuation of Ser. No. 933,087, Aug. 21, 1992, abandoned.

[51] Int. Cl.[5] ..... B26B 13/00

[52] U.S. Cl. ..... 30/260; 30/349

[58] Field of Search ..... 30/251, 254, 260, 349

[56] References Cited

U.S. PATENT DOCUMENTS

| | | | |
|---|---|---|---|
| 1,609,638 | 12/1926 | Zeidler | 30/349 |
| 1,628,856 | 5/1927 | Patrick . | |
| 1,748,701 | 2/1930 | Boyd | 30/349 |
| 2,284,664 | 6/1942 | Kissling | 30/260 |
| 2,353,294 | 7/1944 | Ciarlone | 30/349 |
| 2,660,788 | 12/1953 | Cobb | 30/349 |
| 2,666,258 | 1/1954 | Vogel | 30/349 |
| 2,819,523 | 1/1958 | Stoeveken | 30/260 |
| 3,052,026 | 9/1962 | Muller | 30/260 |
| 5,014,433 | 5/1991 | Tepic | 30/248 |

FOREIGN PATENT DOCUMENTS

| | | | |
|---|---|---|---|
| 2201248 | 7/1973 | Fed. Rep. of Germany . | |
| 350854 | 6/1905 | France | 30/349 |
| 961388 | 5/1950 | France . | |
| 923287 | 4/1963 | United Kingdom . | |

*Primary Examiner*—Richard K. Seidel
*Assistant Examiner*—Hwei-Siu Payer
*Attorney, Agent, or Firm*—Walter C. Farley

[57] ABSTRACT

The scissors are provided with replaceable thin insert blades. The blade insert carriers of the scissors are recessed to receive the blade inserts fixed in place by a screw. The edge-to-edge force at the cutting point is controlled by the bend and the twist of the blade insert carriers. The fixation of the blade inserts by the screw in the front half of the blade insert carriers and their twist in the back section, leaves the cutting edge of the blade inserts unsupported near the pivot point of the scissors. Torsion of the blade inserts allows for easier control of the edge-to-edge force near the pivot without a penalty of the high edge-to-edge compliance towards the tips. Use of replaceable blade inserts eliminates the need for resharpening of the cutting edge and allows for use of the special purpose blade inserts with the same basic scissors.

10 Claims, 3 Drawing Sheets

SCISSORS AND REPLACEABLE TORSION BLADE INSERTS FOR SCISSORS

BACKGROUND OF THE INVENTION

This application is a continuation of Ser. No. 07,933,087 filed Aug. 21, 1992, now abandoned.

FIELD OF THE INVENTION

This invention relates to scissors with upper and lower handles and upper and lower blade carriers, all being essentially arranged in a plane and interconnected by a pivot mechanism. In particular it relates to scissors described in detail in the U.S. Pat. No 5,014,433, where the pivot mechanism is a four-bar linkage.

BACKGROUND ART

Conventional scissors require frequent resharpening, especially in demanding professional use. This calls for scissor disassembly, grinding and reassembly—a costly process, requiring special skills. With unconventional scissors such as described in the U.S. Pat. No. 5,014,433, this is even more complicated, if possible at all, due to multiple joints which may even comprise rolling bearings.

Another problem of scissors is the control of the normal contact force at the edge-to-edge crossing point which moves with closing of the scissors from near the pivot point of the two cutting blades to their tips. A certain contact force is necessary for reliable cutting. This is usually achieved by bending of the blades (if made from sheet metal) or grinding (if forged or cast), in such a way that blade edges push against each other as the scissors are closed. Bending compliance of the blades increases with the third power of the distance from the pivot point. To keep the force between the blade edges approximately constant, they must be bent more towards the tip, but very little near the pivot point. In practice, edge-to-edge contact force near the pivot is controlled by the assembly of the pivot. Any loosening at the pivot will cause a poor function of the scissors at the beginning of the cut when they are near fully opened.

Different types of modular scissors with removable blades are already known; the need for them came with the use of ceramic materials for the cutting blades. These are highly priced professional tools used mostly to cut high strength fibers (carbon, kevlar, glass). However, in these known scissors the whole blade is made in ceramic and is fixed directly to the handle. The disadvantages of this design is that the whole blade has to be replaced which is costly.

SUMMARY OF THE INVENTION

The invention as claimed aims at solving both of the above described problems by providing the scissors with replaceable thin blade inserts, thus eliminating the need for re-sharpening, which are designed and fixed to the blade carriers of the scissors in such a way as to make the normal (perpendicular to the plane of blades) edge compliance near the pivot point high without increasing the compliance at the tips.

The scissors according to the invention are provided with replaceable thin insert blades. The blade insert carriers of the scissors are recessed to receive the blade inserts fixed in place by a screw. The edge-to-edge force at the cutting point is controlled by the bend and the twist of the blade insert carriers. The fixation of the blade inserts by the screw in the front half of the blade insert carriers and their twist in the back section, leaves the cutting edge of the blade inserts unsupported near the pivot point of the scissors. Torsion of the blade inserts allows for easier control of the edge-to-edge force near the pivot without a penalty of the high edge-to-edge compliance towards the tips. Use of replaceable blade inserts eliminates the need for resharpening of the cutting edge and allows for use of the special purpose blade inserts with the same basic scissors.

The advantages offered by the invention are mainly:

very little material is used to produce the blade inserts no need for resharpening possibility to use various blade insert designs and materials for different applications (blade inserts made in hard metals or ceramics can be used to cut kevlar for example with the same basic scissors used to cut silk).

The various features of novelty which characterize the invention are pointed out with particularity in the claims annexed to and forming part of this disclosure. For the better understanding of the invention, its operating advantages and specific objects attained by its use, reference should be had to the accompanying drawings, examples and descriptive matter in which are illustrated and described preferred embodiments of the invention.

DETAILED DESCRIPTION OF THE INVENTION

Figure 1:
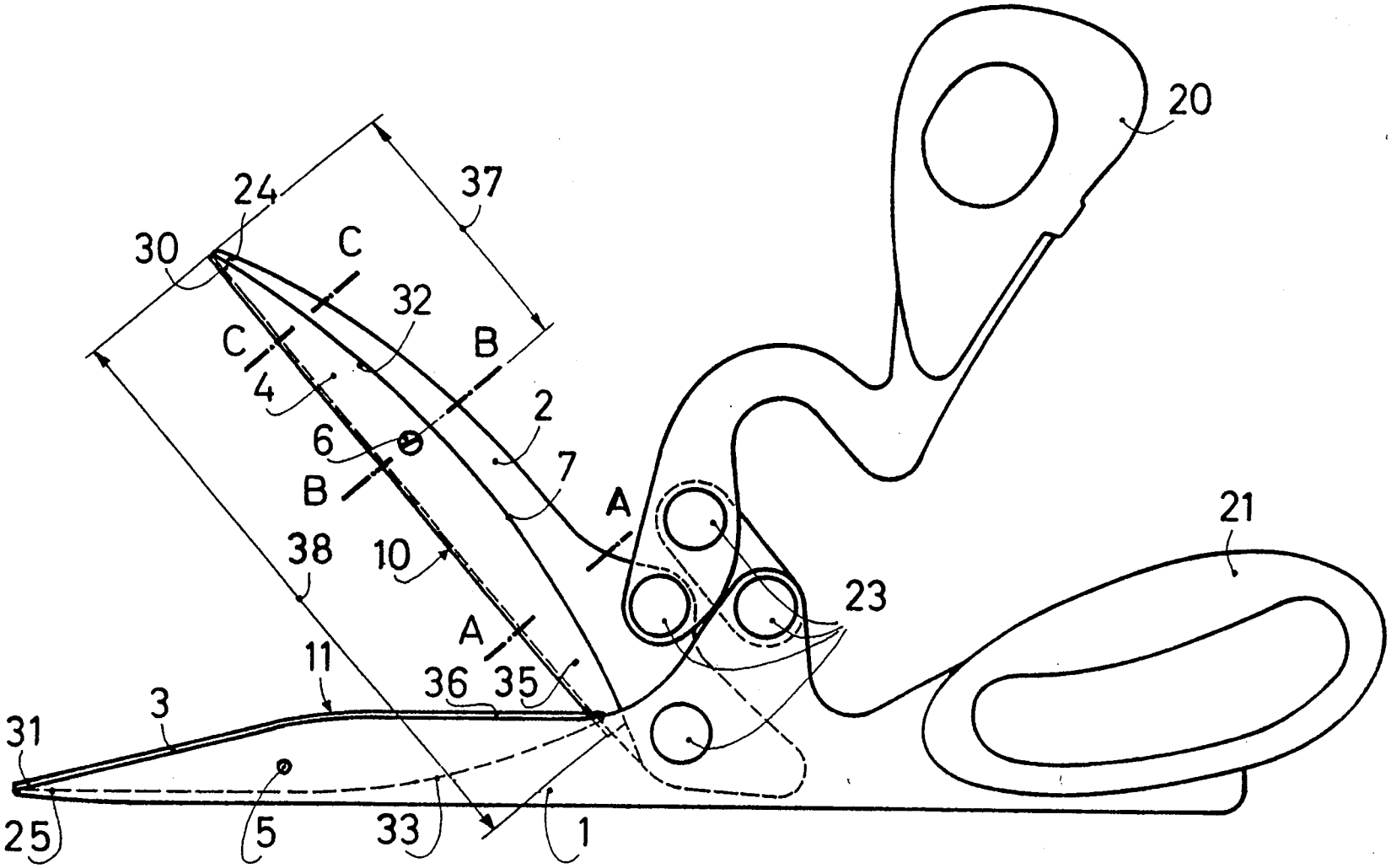
FIG. 1 is a side view of scissors according to the invention.

FIG. 1 shows scissors according to U.S. Pat. No. 5,014,433 having an upper handle 20, a lower handle 21, an upper blade insert carrier 2 and a lower blade insert carrier 1, all being essentially arranged in a plane 22 (FIG. 2 and 5) and interconnected by a pivot mechanism 23 consisting of a four-bar linkage.

The upper and lower blade insert carriers 1,2 are provided with essentially planar upper and lower recesses 18 (FIG. 2) having fixation means 26 for receiving and holding replaceable thin blade inserts 3,4 therein, as shown in the sections A—A, B—B and C—C in FIGS. 2–5. The fixation means 26 consist of screw holes which are located at a distance 37 from the tips 24,25 of blade insert carriers 1,2. The distance 37 is inferior to the distance 38 measured between tip 24 and the pivot mechanism 23 and preferably is less than one half of distance 38.

Each of blade inserts 3,4 has the form of a thin elongated plate with a support edge 32,33, a cutting edge 10,11, a tip 30,31 and a pivot region 35,36. The blade inserts 3,4 are provided with fixation means 28 in the form of holes able to receive fixation means 5,6 in the form of screws by means of which the blade inserts 3,4 can be releasably fastened to the blade insert carriers 1,2. For reasons of material economy, grinding of the edges, and good function the thickness of the blade inserts 3,4 is preferably in the range of 0.5 mm to 1.5 mm.

Figure 3:
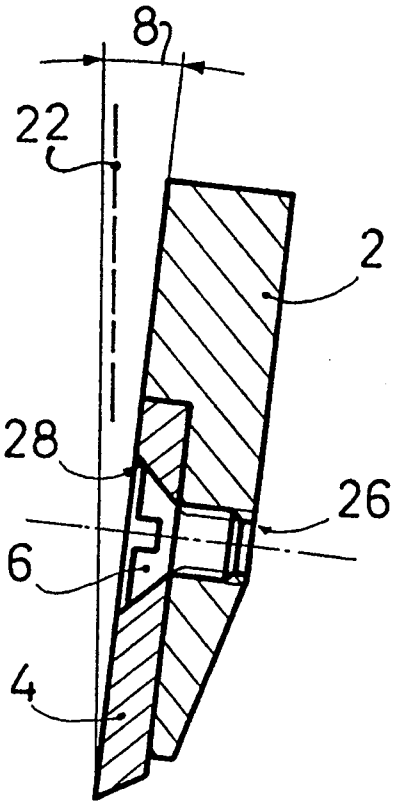
FIG. 3 is a section along line B—B of FIG. 1.

As shown in detail in FIG. 3 the blade insert 4 is held in place by a small screw 6. Analogously blade insert 3 is fixed with screw 5 as shown in FIG. 1. The following detailed description refers only to blade insert 4, but is applicable in the same way to blade insert 3.

Figure 4:
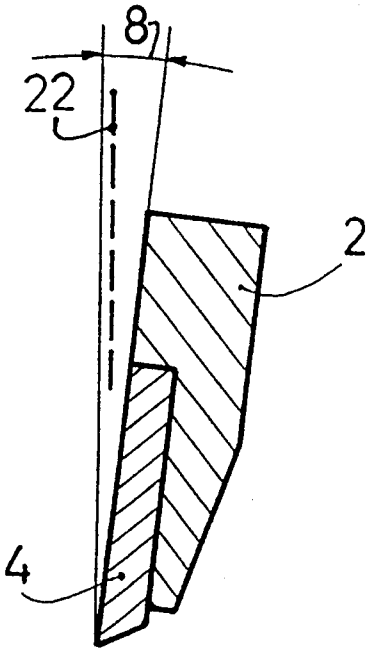
FIG. 4 is a section along line C—C of FIG. 1.
Figure 2:
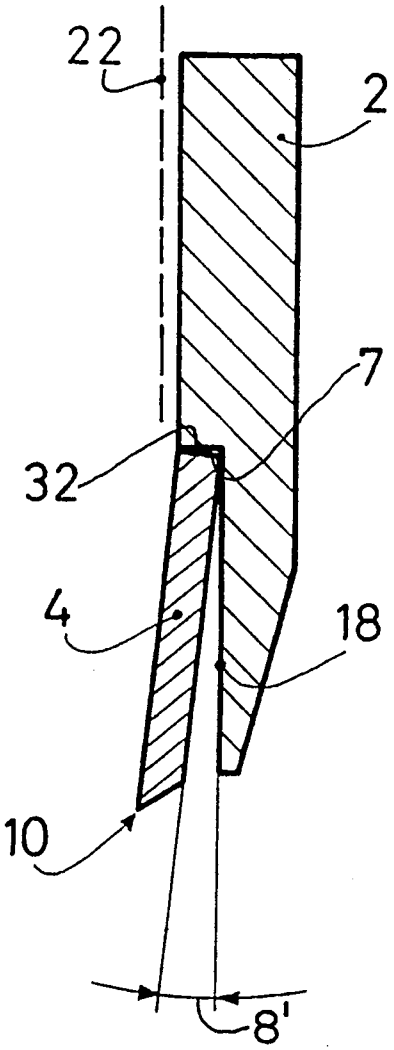
FIG. 2 is a section along line A—A of FIG. 1.
Figure 5:
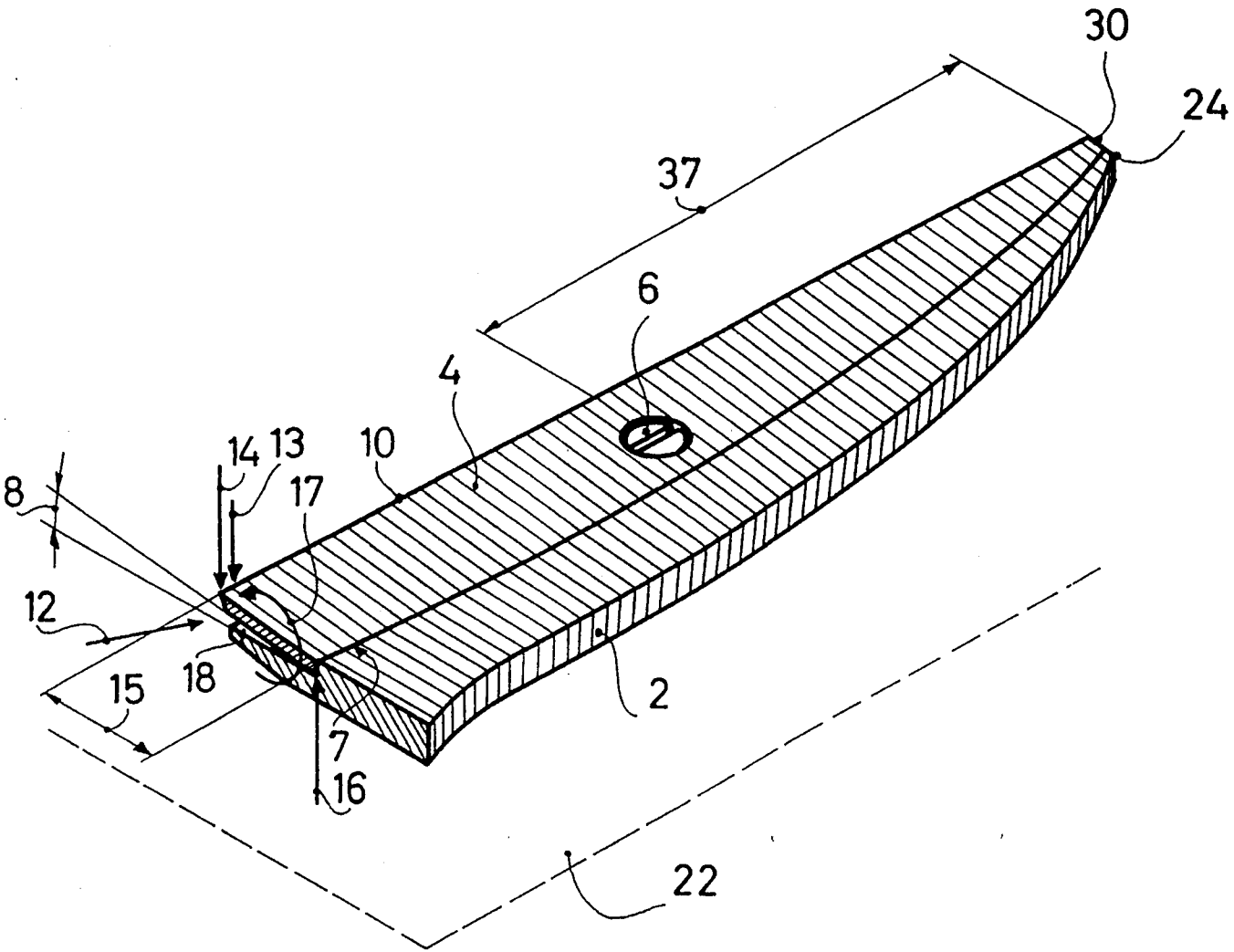
FIG. 5 is a sectioned perspective view of the front portion of the upper blade carrier of the scissors according to FIG. 1.

Support of the blade insert 4 against shear loads of cutting is provided by the edge 7 of recess 18. The blade insert carrier 2 is bent, but also twisted about a longitudinal axis of the blade carrier as can be seen from the sections A—A to C—C (FIGS. 2-4). The twist of the blade insert carrier 2 is made only in the portion between the sections A—A and B—B resulting the twist angle 8'at section A—A, which is the angle between the insert and plane 22, and angle 8 at the section B—B, which is the angle between the carrier and plane 22. The twist angle 8 remains constant to the tip 24 of the blade insert carrier 2. The twist angle 8 on these sections is exaggerated in the figures—in reality the total twist angle 8 is in the range of 1° to 3°. The twist of the blade insert carrier 2 brings the cutting edge 10 of the blade insert 4 and cutting edge 11 of insert 3 out toward each other so that the rest of the blade inserts and of the blade insert carriers clear each other when the scissors are closed. The blade insert 4 is neither bent nor twisted in advance of assembly, but is compliant (flexible) enough to be pulled tight into the recess 18 by the fixation screw 6. This causes bending of the blade insert 4 but very little twist since the front section of the blade insert carrier 2 (where the screw 6 is placed) is not twisted. The result is an angular twist mismatch between the blade insert 4 and the blade insert carrier 2 near the pivot mechanism 23 leaving the cutting edge 10 of blade insert 4 unsupported by the blade insert carrier 2 as shown by arrow 12 on the sectioned perspective view of front section of the upper blade insert carrier 2 (FIG. 5). The gap shown by arrow 12 decreases towards the fixation screw 6. The cutting edge 10 is supported from the fixation screw 6 to the tip 24 by the blade insert carrier 2 and therefore there is no gap in this portion of the blade.

As shown in FIG. 2, the twist angle 8' forming a gap between an inwardly facing surface of the recess 18 of the blade inset carrier 2 and an inner face of the blade insert 4 at a region between the fixation screw 6 and the pivot mechanism 23.

The normal edge compliance, i.e. the ratio of the edge displacement 13 to the normal (perpendicular to the plane 22) force shown by arrow 14, applied to the edge 10 now consists of the total bending compliance of the blade insert carrier 2 and the torsional compliance of the blade insert 4 measured from the point of interest to the fixation point of screw 6. The width 15 of blade insert 4 plays an important role since the reaction force 16 at the support edge 32 of the blade insert 4 (at the recess edge 7) balances the normal force indicated by arrow 14 at the cutting edge 10 and thus generates the torsion moment 17 on the blade insert 4.

This construction gives a considerable design space for controlling the edge compliance of blade inserts 3,4 of the scissors. As the crossing point of the cutting edges 10,11 moves forward, the free twist length of the blade inserts 3,4, and thus their compliance, decreases—near the fixation point of the screws 5,6 it is completely eliminated. However, with the increase of the distance from the pivot mechanism 23 the bending compliance of the blade insert carriers 1,2 (bending stiffness of the blade inserts 3,4 is very low compared to that of the blade insert carriers 1,2) increases—the two compliances—bending of the blade insert carriers 1,2 and the torsional of the blade inserts 3,4—combined with the bend and the twist of the blade insert carriers 1,2 give the desired edge-to-edge normal force and compliance. For reliable cutting not only the normal force at the crossing point, but also the normal compliance are important—the objective is to have a predetermined force with as low compliance as possible. The torsion of the blade insert carriers 1,2 described above makes this design objective much easier to accomplish.

Alternatively, the blade inserts could be twisted and used in conjunction with untwisted blade insert carriers. While the theoretical result would be the same, this possibility is considered less favorable in terms of manufacturing costs.

While the foregoing description and drawings represent the preferred embodiments of the present invention, it will be obvious to those skilled in the art that various changes and modifications may be made therein without departing from the true spirit and scope of the present invention.

I claim:

1. Scissors comprising upper and lower handles connected to elongated upper and lower blade insert carriers each having inwardly and outwardly facing surfaces and a longitudinal axis, all substantially arranged in a plane;

pivot means interconnecting said handles and carriers so that when said handles are moved in one direction said carriers pivot to a position in which the inwardly facing surfaces face toward each other;

means in each of said upper and lower blade insert carriers defining an inwardly opening recess having a substantially planar inwardly facing surface;

first and second replaceable blade inserts respectively receivable in said recesses each of said blade inserts having an inner face;

attachment means for fixedly and releasably holding said blade inserts in said recesses, said attachment means being located a preselected distance from tip ends of said carriers 2. Scissors according to claim 1 wherein said twist angle is between 1° and 3°.

3. Scissors according to claim 1 wherein the thickness of each said insert is between 0.5 and 1.5 mm.

4. Scissors according to claim 1 wherein said at least one carrier is twisted only between said pivot means and said attachment means.

5. Scissors according to claim 1 wherein said preselected distance is equal to 40% to 60% of said distance between said tips and said pivot means.

6. Scissors comprising upper and lower handles connected to elongated upper and lower blade insert carriers each having inwardly and outwardly facing surfaces, all substantially arranged in a plane;

pivot means interconnecting said handles and carriers so that when said handles are moved in one direction said carriers pivot to a position in which the inwardly facing surfaces face toward each other;

means in each of said upper and lower blade insert carriers defining an inwardly opening recess having a substantially planar inwardly facing surface;

first and second replaceable blade inserts respectively receivable in said recesses, each insert having a longitudinal axis and an inner face;

attachment means for fixedly and releasably holding said blade inserts in said recesses, said attachment means being located a preselected distance from tip ends of said carriers, said preselected distance being less than a distance between said tip ends and said pivot means, said attachment means acting along a transverse axis substantially perpendicular to said plane; and at least one of said inserts being twisted about said longitudinal axis through a predetermined twist angle relative to said plane; whereby said twist angle defines a gap between the substantially planar inwardly facing surface of said recess of said at least one blade carrier and the inner face of its respective blade insert at a region between the attachment means and the pivot means.

7. Scissors according to claim 6 wherein said twist angle is between 1° and 3°.

8. Scissors according to claim 7 wherein the thickness of each said insert is between 0.5 and 1.5 mm.

9. Scissors according to claim 6 wherein said at least one insert is twisted only between said pivot means and said attachment means.

10. Scissors according to claim 6 wherein said preselected distance is equal to 40% to 60% of said distance between said tips and said pivot means.

* * * * *